US009156530B2

(12) United States Patent
Best et al.

(10) Patent No.: US 9,156,530 B2
(45) Date of Patent: Oct. 13, 2015

(54) INFLATION DEVICE MECHANISM

(76) Inventors: Michael E. Best, Southhampton (GB); John Perrins, Leamington Spa (GB)

( * ) Notice: Subject to any disclaimer, the term of this patent is extended or adjusted under 35 U.S.C. 154(b) by 70 days.

(21) Appl. No.: 13/884,374

(22) PCT Filed: Nov. 10, 2011

(86) PCT No.: PCT/GB2011/001581

§ 371 (c)(1),
(2), (4) Date: Aug. 6, 2013

(87) PCT Pub. No.: WO2012/063020

PCT Pub. Date: May 18, 2012

(65) Prior Publication Data

US 2013/0313282 A1 Nov. 28, 2013

(30) Foreign Application Priority Data

Nov. 11, 2010 (GB) ..... GB1019087.4

(51) Int. Cl.

| | |
|---|---|
| ***B67D 7/00*** | (2010.01) |
| ***B63C 9/19*** | (2006.01) |
| ***B60C 29/00*** | (2006.01) |
| *B63C 9/00* | (2006.01) |

(52) U.S. Cl.

CPC ... *B63C 9/19* (2013.01); *B63C 9/24* (2013.01); *B63C 2009/007* (2013.01); *B63C 2009/0041* (2013.01)

(58) Field of Classification Search

CPC ..... B63C 9/19; B63C 9/24
USPC ..... 222/5, 54; 441/93, 94, 95
See application file for complete search history.

(56) References Cited

U.S. PATENT DOCUMENTS

| | | | | | |
|---|---|---|---|---|---|
| 2,894,658 | A | * | 7/1959 | Spidy | 222/5 |
| 4,475,664 | A | * | 10/1984 | Mackal | 222/5 |
| 4,498,605 | A | * | 2/1985 | Mackal et al. | 222/5 |
| 5,273,185 | A | * | 12/1993 | Sacarto | 222/5 |
| 6,435,371 | B1 | * | 8/2002 | Perrins | 222/5 |

FOREIGN PATENT DOCUMENTS

| | | |
|---|---|---|
| EP | 1109717 | 3/2000 |

* cited by examiner

*Primary Examiner* — J. Casimer Jacyna
*Assistant Examiner* — Benjamin R Shaw
(74) *Attorney, Agent, or Firm* — Clifford H. Kraft

(57) ABSTRACT

An inflation device mechanism (10) for inflation of an inflatable article comprises a housing (11) for supporting a container (18) of pressurized fluid and a piercing device (16) displaceable from a retracted position to penetrate the container to release pressurized fluid, bias means (22) to move the piercing device to penetrate the container, and actuation means comprising co-operating latching elements (26, 30) which, in an engaged, latched configuration, retain the piercing device retracted, said actuation means being actuable by either a first (35) or a second (36) control member to allow the latching elements to disengage and permit the piercing device to penetrate the container under action of the bias means, the first control member (35) comprising a water sensitive member which surrounds the latching elements and has a strength sufficient normally to support the latching elements in the engaged configuration but to allow the elements to disengage when reduced in strength by exposure to water, and the second control member (36) comprising a member which surrounds the co-operating elements and is removable manually (38) whereby the latching elements are free to disengage.

20 Claims, 5 Drawing Sheets

INFLATION DEVICE MECHANISM

This invention relates to an inflation device mechanism and inflation device for an inflatable article and in particular, though not exclusively, to an inflation device and mechanism for life jackets and the like.

For life jacket inflation devices of the type which actuate automatically when submerged in water, and also for many inflation devices of the type which are manually actuated, it is well know to provide the inflation device with a small gas cylinder which is punctured in response to manual actuation or automatic actuation on contact with water so as to release pressurised gas for inflation of the life jacket.

One known and successful inflation device which features the combination of manual and automatic operation is that the subject of our European patent EP 1109717-B1.

In EP 1109717 there is described an inflation device having a so-called firing mechanism comprising a piston unit, sometimes known as piercing device, which is axially moveable in response to either a manual or automatic actuation. The piston unit provides at one end a mount for a piercing knife and at the other end a split skirt that comprises a set of flexible fingers moveable, in response to manual or automatic actuation, to allow the piston unit to advance axially under the action of a helical compression spring from a retracted position and thereby cause a piercing knife to puncture the gas cylinder seal.

Although this construction results in an inflation device that operates successfully, in order to construct the piston unit as a single moulding and thus contain costs, particular care is needed in the design and selection of materials for the piston unit such that it is sufficiently rigid to provide good support for a piercing knife but also to enable the fingers to be sufficiently flexible and to respond quickly in the event of manual actuation. Furthermore it does not lend itself readily to a variation in which the material is sufficiently rigid to enable a piercing knife to be formed integrally as a part of the piston unit, and particular care is needed to ensure that the force required for manual actuation will always be within acceptable limits.

The present invention seeks to provide an improved inflation device mechanism for an inflation device for an inflatable article.

In accordance with one aspect of the present invention there is provided an inflation device mechanism for an inflation device for an inflatable article, said inflation device mechanism comprising:— a housing for supporting a container of pressurised fluid and for supporting a piercing device which is displaceable from a retracted position to penetrate the container and allow release of pressurised fluid;

bias means operable to move the piercing device from said retracted position to penetrate the container, and actuation means comprising co-operating latching elements which, when in an engaged, latched configuration, retain the piercing device in said retracted position;

said actuation means being responsive to actuation by either a first or a second control member to allow the co-operating latching elements to disengage and thereby permit the piercing device to advance from said retracted position to penetrate the container under the action of the bias means;

said first control member comprising a water sensitive member which surrounds said co-operating latching elements and has a strength sufficient normally to support said co-operating latching elements in an engaged configuration but to allow the co-operating latching elements to disengage when the water sensitive member is reduced in strength by exposure to water, and said second control member comprising a member which surrounds the co-operating latching elements and is removable manually from said position at which it surrounds the co-operating latching elements whereby the co-operating latching elements are allowed to disengage.

Preferably said co-operating latching elements move in a direction substantially perpendicular to the direction of movement of the piercing device when disengaging in response to operation of one of the control members.

To facilitate freedom of the piercing device to advance from the retracted position when either of the first and second control members is operated, the co-operating latching elements preferably comprise confronting bearing surfaces which are inclined relative to the direction of advance so that the action of the bias means to create a loading on said confronting abutment surfaces readily causes the co-operating latching elements to move from a latched configuration in a direction substantially perpendicular to said direction of advance and thus to disengage.

A first of the co-operating latching elements may be a part of the piercing device, to be movable therewith and a second may be provided by a member, such as a collet, secured in position relative to the housing.

One of the co-operating latching elements may comprise a recess formation to provide a bearing surface which is engaged by a protrusion formation of the other of the co-operating latching elements when in the engaged, latched configuration.

A second of the co-operating latching elements may comprise a collet secured to the housing and provided with a plurality of fingers which extend axially from an annular part of the collet, distal ends of the fingers each having a protrusion formation or a recess which provides a bearing surface to co-operate with a recess or protrusion formation of a first of the co-operating latching elements. Said collet may be secured to the housing by, for example, adhesive, by a screw thread, and or by being moulded integrally with the housing.

Said first control member may comprise a water sensitive member in the form of a sleeve, such as a paper sleeve, which surrounds the co-operating latching elements normally to hold them in the engaged configuration but to allow unlatching to a disengaged configuration when reduced in strength by exposure to water.

Said second control member may comprise a sleeve-like member which is axially displaceable, by manual action, in a direction opposite that in which the piercing device advances when moving from the retracted position. Said manual displacement of the second control member allows the co-operating latching elements to disengage.

The second control member may be of a substantially tubular shape, for example substantially cylindrical and may be peripherally discontinuous. Preferably it comprises two or more, preferably at least four, lengthwise extending slits or gaps thereby to provide a plurality of finger-like formations which allow the second control member to be able to expand radially.

The second control member may be positioned to surround the co-operating latching elements and to lie interposed between one of said elements and the first, water sensitive control member. In this configuration the second control member is radially expansible in the event of wetting and thus weakening of the first control member. This allows the co-operating latching elements to disengage and the piercing device to advance for penetrating a gas cylinder.

In the case of manual actuation the withdrawal of the second control member from between a co-operating latching element and the first control member may provide an annular space into which one of the co-operating latching elements may be urged thereby to allow the said co-operating latching elements to disengage. Alternatively or additionally the action of withdrawal of the second control member may be arranged to effect also withdrawal of the first control member whereby the co-operating latching elements are free to disengage even though they need to move out radially by a distance greater than the radial thickness of the second control member in order to unlatch.

The second control member may comprise a plurality of flat fingers which are freely slidable relative to a co-operating latching element and the first control member between which it is positioned. However, optionally the second control member may comprise formations, such as outwardly extending lips on the distal ends of fingers, or textured outer surfaces on the fingers, whereby they assist withdrawal of the first control member concurrent with withdrawal of the second control member.

The manually operable second control member and the second of the co-operating latching elements, e.g. that associated with a collet, may each comprise a plurality of flexible fingers which extend lengthwise parallel with the direction of movement of the piercing device from the retracted position.

Preferably the co-operating element comprises a first plurality of fingers which are each overlapped at least in part by at least one finger of the second plurality of fingers provided by the second control member. Preferably fingers of the second control member are positioned to lie over the slits or any gaps which extend lengthwise between the fingers of the co-operating latching element, said slits or gaps being those which allow fingers of the co-operating latching element to move apart, at least at their distal ends, in the event of operation of one of the control members.

The fingers of at least one of the two pluralities may comprise guide formations whereby each finger of one plurality is maintained in an off-set alignment relative to fingers of the other plurality. Each outer finger, of the second plurality, preferably lies over and in contact with each of two adjacent fingers of the co-operating latching element. Each outer finger of the second control member preferably lies over and in contact with each of two adjacent fingers of the co-operating latching element. Successive outer fingers of the second plurality may be spaced by rib formations provided on the outer faces of each of the (e.g. collet) fingers of one of the co-operating latching elements. Preferably said ribs extend outwards by a distance corresponding to the (radial) thickness of the outer fingers of the second control member whereby the interdigitated fingers provide a substantially smooth outer surface for bearing uniformly against a first control member such as a paper sleeve.

In an alternative configuration the first control member may lie interposed between a co-operating latching element and a surrounding second control member. In this configuration removal of the second control member preferably is arranged to result in simultaneous withdrawal of the first control member.

The second control member may be formed integral with a housing end cap that in normal use sits firmly as a sliding fit within an end of the housing. An emergency pull cord may be secured to the end cap such that withdrawal of the cap by pulling the cord results in withdrawal of the second control member and, optionally, also withdrawal of the first control member thereby to result in manual actuation of the mechanism.

Said end cap or adjacent part of the housing may be apertured or relieved to facilitate ingress of water for automatic actuation of the mechanism.

The piercing device may provide support for or be formed integrally e.g. by moulding, with a piercing head for rupture of a gas cylinder.

The present invention provides also an inflation device comprising an inflation device mechanism according to the invention, a housing having means for attachment of a gas cylinder, and an outlet port for attaching to the manifold of an inflatable article.

One embodiment of the present invention will now be described, by way of example only, with reference to the accompanying diagrammatic drawings in which:—

FIG. 1 is a sectional view of part of an inflation device incorporating an inflation device mechanism in accordance with a first embodiment of the present invention;

FIG. 1*a* shows part of FIG. 1 enlarged;

Figure 3:
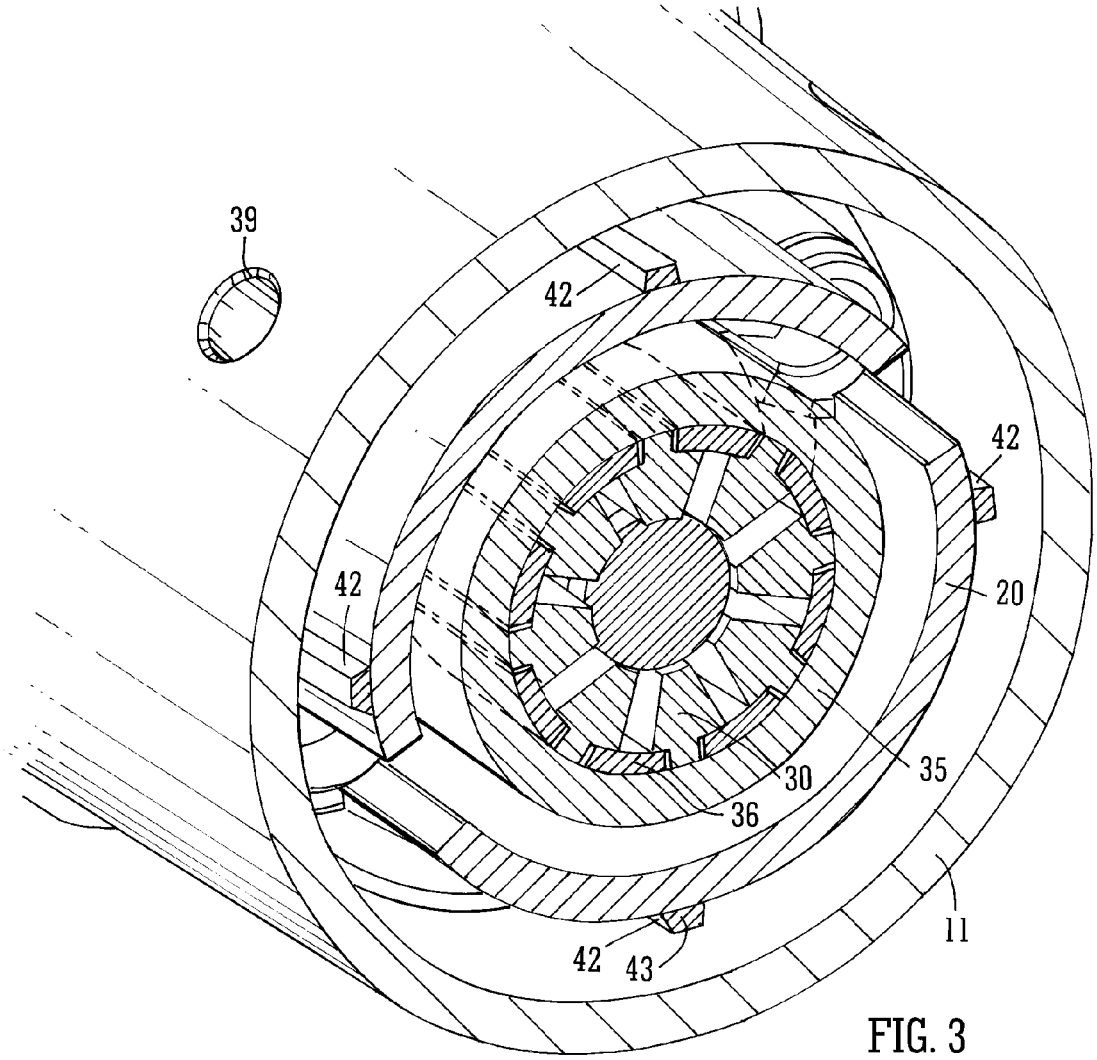
FIG. 3 is a perspective view of a cut away part of the end region of the mechanism to show the fingers assembly.
Figure 3A:
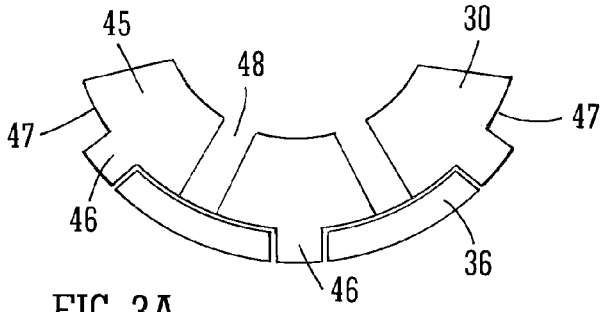

FIG. 3*a* shows a part of FIG. 3 enlarged, and

Figure 4:
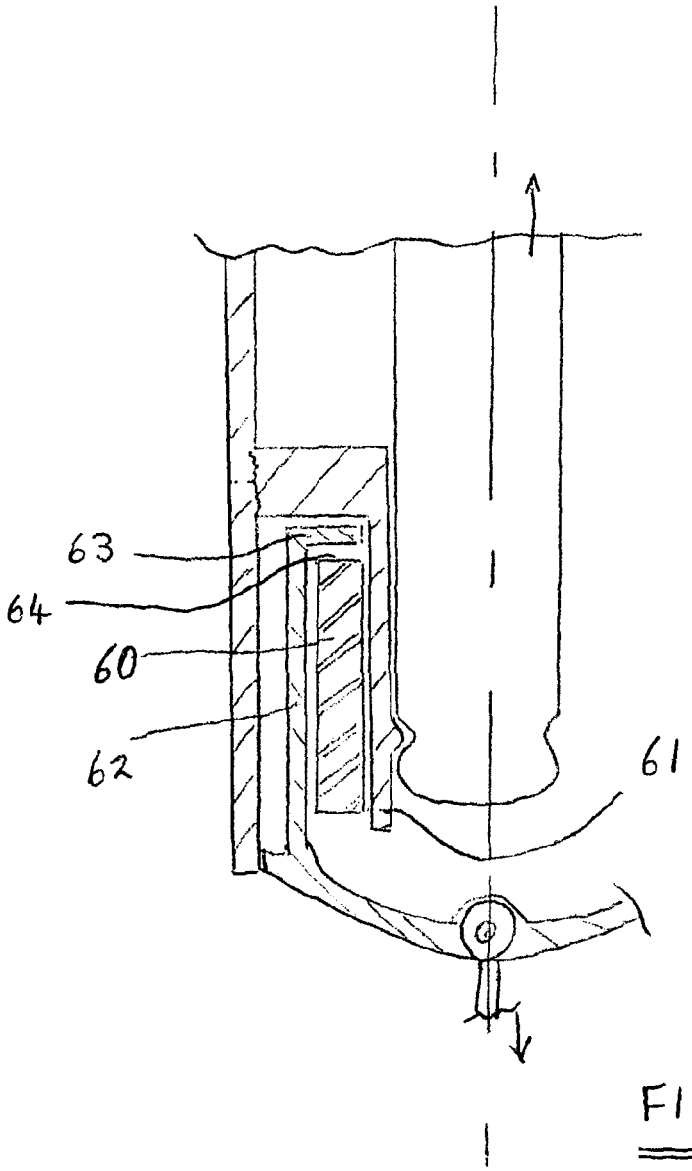

FIG. 4 is a sectional view of part of an inflation device mechanism in accordance with a second embodiment of the invention.

An inflation device firing mechanism 10 comprises a housing 11 having a first end region 12 which is screw threaded for attachment of a gas cylinder 18. A second end region 13 defines a chamber 14 in which moveable parts of the mechanisms are located.

A passage 15 extends from the chamber 14 to the screw threaded end to allow axial movement of a piercing head 16 into engagement with and to rupture the seal of a gas cylinder. A retention clip 19, which may be substantially as described in our co-pending UK patent application GB 1019053.6 entitled Inflation Device, enables an outlet port of the inflation device to be secured to the manifold of an inflatable article.

The piercing head 16 is at one end of a plunger unit 17 which is axially slidable in the direction of the length of the housing.

A collet 20 is secured axially, as a screw thread fit, within the housing and provides a reaction face 21 for a compression spring 22 which acts on a plunger shoulder 23 to urge the plunger 17 to move in a direction towards a housing abutment face 24 and thus also advance the piercing head 16 to rupture a gas cylinder.

Figure 1:
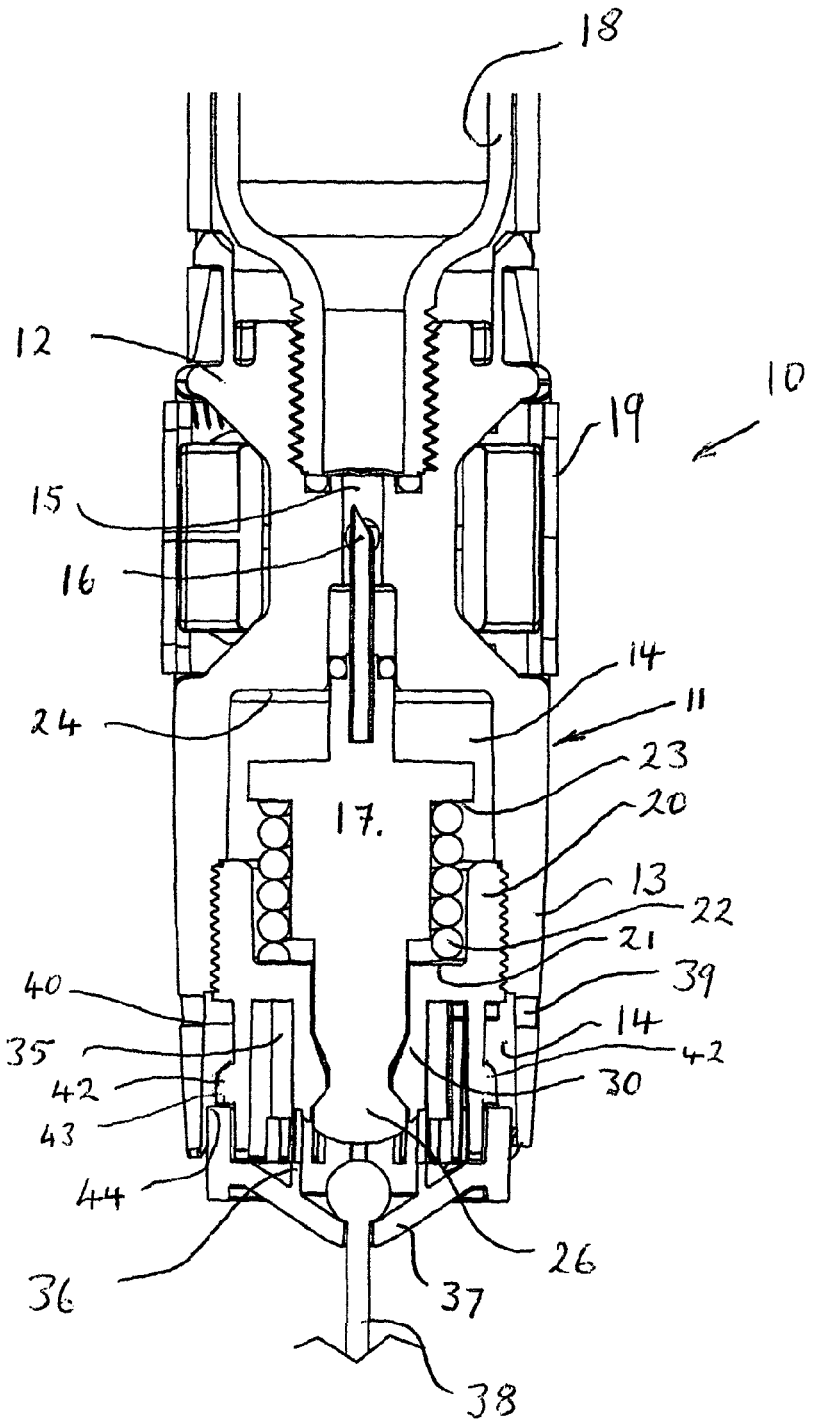
Figure 2:
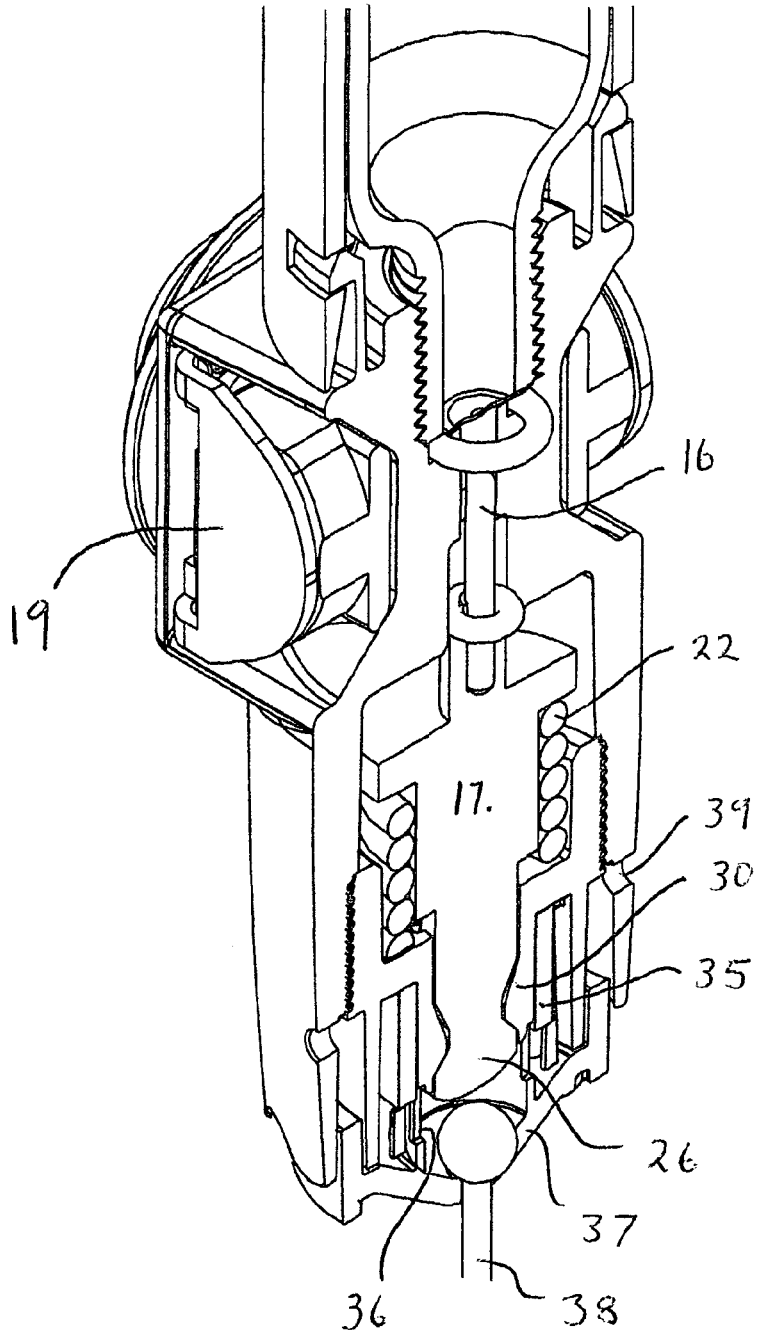
FIG. 2 is a perspective view of the components shown in FIG. 1.

The end 26 of the plunger opposite the piercing head defines one of a pair of co-operating latching elements which act to retain the plunger in the retracted, latched position as shown in FIGS. 1 & 2.

The end 26 has a circumferentially extending groove 27 (see also FIG. 1*a*) comprising an inclined bearing surface 28 which lies at an angle of approximately 45° relative to the direction of axial movement.

The groove 27 provides location for lip formations 29 at the ends of each of eight uniformly circumferentially spaced collet fingers 30 that extend from the collet 20. The lip formations each have an inclined bearing surface 31 which, in the retraced configuration, bear against the annular groove surface 28.

The collet fingers 30 normally are held in engagement with the groove bearing surface 28 by a surrounding paper sleeve 35 and a plurality of eight control fingers 36 which are uniformly circumferentially spaced and lie interposed between the collet fingers and the paper sleeve.

The two pluralities of fingers are arranged in an interdigitated manner and provide a substantially smooth outer surface for bearing uniformly against the paper sleeve 35.

The collet fingers each have a body region 45 of a wedge like shape as viewed in cross section (see FIG. 3*a*) and lie circumferentially spaced apart. The outer face of each collet finger has a lengthwise extending rib 46 thereby to define a pair of lengthwise extending shoulder regions 47. The second control member fingers 36 are of a generally rectangular shape and each is supported by the two shoulders regions 47 of a pair of adjacent collet fingers thereby also to span the gap 48 between the collet fingers. Thus the control fingers 36 are positively supported and guided such that they are restrained from any tendency to slip inwardly between collet fingers.

The interposed fingers 36 each extend from an end cap 37 which is a firm fit in the end of the housing. A pull cord 38 is attached to the end cap and allows the cap together with the interposed fingers to be withdrawn from the housing.

Figure 1A:
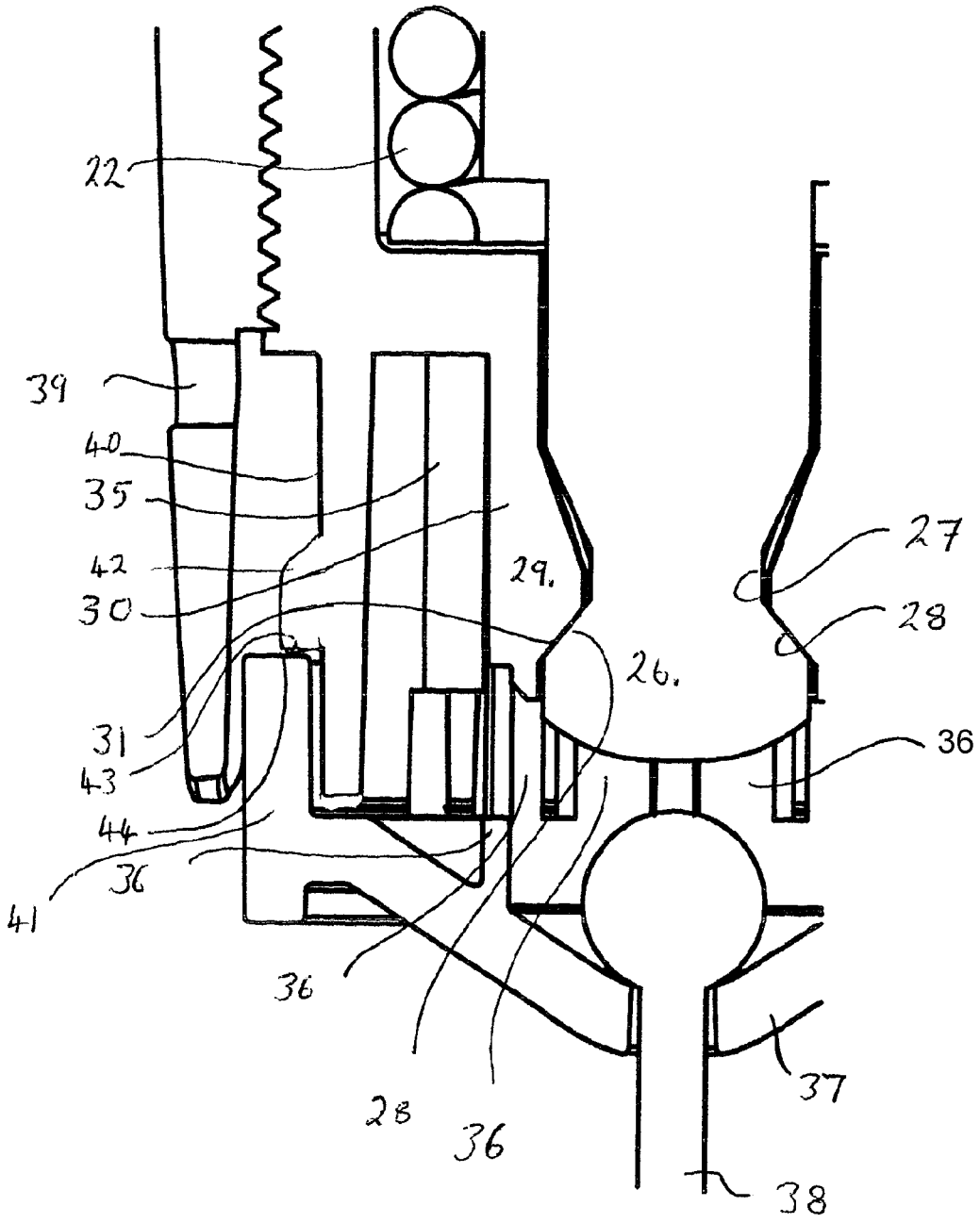

The outer surface 40 of that part of the collet which surrounds the paper sleeve 35 is provided with a series of four circumferentially spaced ribs 42 (visible in FIGS. 1, 1*a* and 3). The end surfaces 43 of these ribs acts as end stops and are abutted by the annular end surface 44 of the outer cylindrical portion 41 of the end cap 37 which is thereby prevented from movement in an inwards direction.

Small apertures 39 are provided between the housing and cap to allow ingress of water into contact with the paper sleeve 35.

In this construction the paper sleeve 35 acts, when wetted, as a first control member to cause automatic operation of the firing mechanism and rupture of a cylinder seal, and the end cap fingers 36 act as a second control member for manual actuation.

In the event of cord 38 being pulled the end cap fingers slide outwards over the outer surfaces of the collet fingers 30. The collet fingers are biased outwards under the action of the force existing between the confronting inclined surfaces 28, 31 due to the action of the spring 22. In consequence the outer surfaces of the end cap fingers 36 bear firmly against the paper sleeve 35 which thereby is withdrawn concurrent with withdrawal of the end cap and fingers 36.

Accordingly the co-operating abutment surfaces 28,31 disengage from a latched configuration to allow advance of the piercing head and rupture of a cylinder.

In the event of water ingress the paper sleeve softens and ceases to resist the radially outwards bias force which the collet fingers exert on the sleeve, via the interposed and flexible end cap fingers. As in respect of the manual actuation, the co-operating abutment surfaces disengage to allow advance of the piercing head and rupture of a cylinder, In a second embodiment of the invention a firing mechanism for an inflation device is constructed substantially as in respect of the first embodiment except that the positions of the paper sleeve and the end cap fingers are exchanged. As shown in FIG. 4 the sleeve 60 lies interposed between the collet fingers 61 and the end cap fingers 62. A small annular gap between the sleeve 60 and fingers 62 allows the sleeve to expand outwardly when wetted thereby to allow the collet fingers to disengage from the plunger in a manner similar to that described in respect of the first embodiment of the present invention. The end cap fingers have inwardly directed end lips 63 to engage with the axially inner ends 64 of the sleeve thereby to ensure that in the event of manual actuation the sleeve is withdrawn in unison with the collet fingers.

The invention claimed is:

1. An inflation device mechanism for an inflation device for an inflatable article, said inflation device mechanism comprising:— a housing for supporting a container of pressurized fluid and for supporting a piercing device which is displaceable from a retracted position to penetrate the container and allow release pressurized fluid;

bias means operable to move the piercing device from said retracted position to penetrate the container, and actuation means comprising co-operating latching elements which, when in an engaged, latched configuration, retain the piercing device in said retracted position;

said actuation means being responsive to actuation by either a first or a second control member to allow the co-operating latching elements to disengage and thereby permit the piercing device to advance from said retracted position to penetrate the container under the action of the bias means;

said first control member comprising a water sensitive member which surrounds said co-operating latching elements and has a strength sufficient normally to support said co-operating latching elements in an engaged configuration but to allow the co-operating latching elements to disengage when the water sensitive member is reduced in strength by exposure to water, and said second control member comprising a member which surrounds the co-operating latching elements and is removable manually from said position at which it surrounds the co-operating latching elements whereby the co-operating latching elements are allowed to disengage.

2. An inflation device mechanism according to claim 1 wherein said co-operating latching elements move in a direction substantially perpendicular to the direction of movement of the piercing device when disengaging in response to operation of one of the control members.

3. An inflation device mechanism according to claim 2 wherein the co-operating latching elements comprise confronting bearing surfaces which are inclined relative to the direction of advance of the piercing device whereby action of the bias means to create a loading on said confronting abutment surfaces causes the co-operating elements to move in a direction substantially perpendicular to said direction of advance and thus to disengage when either of the first and second control members is operated.

4. An inflation device mechanism according to claim 1 wherein one of the co-operating latching elements moves radially solely in a radially outwards direction as it changes from an engaged to a disengaged configuration in the event of operation of either of the first and second control members.

5. An inflation device mechanism according to claim 1 wherein one of the co-operating latching elements comprises a recess formation having a bearing surface which is engaged by a protrusion formation of the other of the co-operating latching elements when in the engaged configuration.

6. An inflation device mechanism according to claim 1 wherein one of the co-operating latching elements comprises a collet secured to the housing and provided with a plurality of fingers which extend axially from an annular part of the collet, distal ends of the fingers each having a protrusion formation or a recess formation which provides a bearing surface to co-operate with a recess or protrusion formation of the other of the co-operating latching elements.

7. An inflation device mechanism according to claim 1 wherein said first control member comprises a water sensitive member in the form of a sleeve which surrounds the co-operating latching elements normally to hold them in the engaged, latched configuration but to allow movement to a disengaged configuration when reduced in strength by exposure to water.

8. An inflation device mechanism according to claim 1 wherein said second control member comprises a sleeve-like member which is axially displaceable by manual action in a direction opposite that in which the piercing device advances when moving from the retracted position thereby to allow the co-operating latching elements to disengage.

9. An inflation device mechanism according to claim 1 wherein said second control member is of a substantially tubular shape and comprises a plurality of lengthwise extending slits or gaps thereby to provide a plurality of finger-like formations which allow the control member to be able to expand radially.

10. An inflation device mechanism according to claim 1 wherein said second control member surrounds the co-operating latching elements and lies interposed between one of said elements and the first control member.

11. An inflation device mechanism according to claim 10 wherein manual withdrawal of the second control member provides an annular space into which one of the co-operating latching element may be urged thereby to allow said co-operating latching elements to disengage.

12. An inflation device mechanism according to claim 10 wherein withdrawal of the second control member from between a co-operating element and the first control member effects also withdrawal of the first control member.

13. An inflation device mechanism according to claim 1 wherein the second control member comprises a plurality of fingers which are freely slidable relative to a co-operating latching element.

14. An inflation device mechanism according to claim 1 wherein the second control member comprises a formation or surface texture whereby the first control member is withdrawn concurrent with withdrawal of the second control member.

15. An inflation device mechanism according to claim 1 wherein a co-operating latching element comprises a first plurality of fingers which are each overlapped at least in part by at least one finger of a second plurality of fingers provided by the second control member.

16. An inflation device mechanism according to claim 15 wherein fingers of the second control member lie over slits or gaps between fingers of the co-operating latching element.

17. An inflation device mechanism according to claim 15 wherein fingers of at least one of the two pluralities comprise guide formations to maintain fingers of one plurality in an off-set alignment relative to fingers of the other plurality as viewed in a plane perpendicular to the direction in which the piercing device advances from the retracted position.

18. An inflation device mechanism according to claim 1 wherein the second control member is integral with a housing end cap which is a sliding fit and removable from within an end of the housing.

19. An inflation device mechanism according to claim 18 wherein said end cap or adjacent part of the housing is apertured or relieved to facilitate ingress of water into contact with the first control member.

20. An inflation device comprising an inflation device mechanism according to claim 1, a housing adapted for attachment of a gas cylinder, and a housing outlet port for attaching to the manifold of an inflatable article.

* * * * *